US008944774B2

(12) United States Patent
Bielek

(10) Patent No.: US 8,944,774 B2
(45) Date of Patent: Feb. 3, 2015

(54) GAS TURBINE NOZZLE WITH A FLOW FENCE

(75) Inventor: Craig Allen Bielek, Greenville, SC (US)

(73) Assignee: General Electric Company, Schenectady, NY (US)

( * ) Notice: Subject to any disclaimer, the term of this patent is extended or adjusted under 35 U.S.C. 154(b) by 321 days.

(21) Appl. No.: 13/342,256

(22) Filed: Jan. 3, 2012

(65) Prior Publication Data

US 2013/0170997 A1 Jul. 4, 2013

(51) Int. Cl.
*F01D 9/02* (2006.01)
*F04D 29/38* (2006.01)
*F01D 5/14* (2006.01)

(52) U.S. Cl.
USPC ..... 416/236 A; 416/236 R

(58) Field of Classification Search
CPC ..... F04D 29/24; F04D 29/242; F04D 29/245; F04D 29/32; F04D 29/544; F04D 29/326; F04D 29/388; F04D 29/542; F01D 1/02; F01D 5/142; F01D 5/145; F01D 9/02; F01D 9/041
USPC ..... 416/223 R, 228, 243, 236 A, 236 R, 235, 416/231 B; 415/208.1, 208.2, 191
See application file for complete search history.

(56) References Cited

U.S. PATENT DOCUMENTS

| | | | | |
|---|---|---|---|---|
| 1,022,203 | A * | 4/1912 | Nettle | 416/236 R |
| 1,152,426 | A | 9/1915 | McCarroll | |
| 1,614,235 | A * | 1/1927 | Doran | 415/107 |
| 2,041,793 | A | 5/1936 | Stalker | |
| 2,245,237 | A * | 6/1941 | Truex | 415/209.4 |
| 2,421,890 | A * | 6/1947 | Johansson | 416/193 R |
| 2,573,834 | A | 11/1951 | Davidson | |
| 2,650,752 | A | 9/1953 | Hoadley | |
| 3,012,709 | A * | 12/1961 | Schnell | 416/236 R |
| 3,193,185 | A * | 7/1965 | Erwin et al. | 415/193 |
| 3,351,319 | A * | 11/1967 | Frost | 415/209.2 |
| 3,524,712 | A * | 8/1970 | Keen et al. | 416/233 |
| 3,588,005 | A | 6/1971 | Rethorst | |
| 4,108,573 | A * | 8/1978 | Wagner | 416/236 A |
| 4,128,363 | A * | 12/1978 | Fujikake et al. | 416/236 A |
| 4,706,910 | A | 11/1987 | Walsh et al. | |
| 4,884,944 | A | 12/1989 | Tate | |
| 5,161,947 | A * | 11/1992 | Eckfeldt et al. | 415/211.2 |
| 5,738,298 | A | 4/1998 | Ross et al. | |

(Continued)

FOREIGN PATENT DOCUMENTS

| | | |
|---|---|---|
| DE | 700625 | 12/1940 |
| DE | 2135287 A1 | 1/1973 |
| EP | 0978633 A1 | 2/2000 |

(Continued)

OTHER PUBLICATIONS

M.J. Walsh, Title: "Grooves reduce aircraft drag", NASA Technical Reports Server (NTRS), Date: Sep. 1, 1980, pp. 1.
EP Search Report and Written Opinion dated Feb. 20, 2014 issued in connection with corresponding EP Application No. 12197717.7.

*Primary Examiner* — Dwayne J White
*Assistant Examiner* — Joshua R Beebe
(74) *Attorney, Agent, or Firm* — Sutherland Asbill & Brennan LLP

(57) ABSTRACT

The present application provides a turbine nozzle. The turbine nozzle may include an airfoil with a leading edge and a trailing edge and a flow fence extending from the leading edge to the trailing edge.

17 Claims, 5 Drawing Sheets

(56) References Cited

U.S. PATENT DOCUMENTS

| | | | | |
|---|---|---|---|---|
| 2006/0060722 | A1 | 3/2006 | Choi et al. | |
| 2010/0135813 | A1 * | 6/2010 | Marini et al. | 416/223 R |

FOREIGN PATENT DOCUMENTS

| | | | |
|---|---|---|---|
| FR | 2938871 | A1 | 5/2010 |
| GB | 840543 | A | 7/1960 |

* cited by examiner

GAS TURBINE NOZZLE WITH A FLOW FENCE

TECHNICAL FIELD

The present application and the resultant patent relate generally to a turbine nozzle for a gas turbine engine and more particularly relate to a turbine nozzle with a flow fence positioned on a suction side or elsewhere so as to limit radial now migration and turbulence.

BACKGROUND OF THE INVENTION

In a gas turbine, many system requirements should be met at each stage of the gas turbine so as to meet design goals. These design goals may include, but are not limited to, overall improved efficiency and airfoil loading capability. As such, a turbine nozzle airfoil profile should achieve thermal and mechanical operating requirements for a particular stage. For example, last stage nozzles may have a region of significantly high losses near an outer diameter. These loses may be related to radial flow migration along an inward suction side. Such radial flow migration may combine with mixing losses so as to reduce blade row efficiency. As such, a reduction in radial now migration with an accompanying reduction in the total pressure loss should improve overall performance and efficiency.

There is thus a desire for an improved turbine nozzle design, particularly for a last stage nozzle. Such an improved turbine nozzle design should accommodate and/or eliminate radial flow migration and associated loses about the airfoil. Such a reduction in radial flow migration and the like should improve overall performance and efficiency. Overall cost and maintenance concerns also should be considered and addressed herein.

SUMMARY OF THE INVENTION

The present application and the resultant patent provide an example of a turbine nozzle. The turbine nozzle described herein may include an airfoil with a leading edge and a trailing edge and a flow fence extending from the leading edge to the trailing edge.

The present application and the resultant patent further provide an example of a turbine. The turbine described herein may include a number of stages with each of the stages including a number of nozzles and a number of buckets. Each of the buckets may include an airfoil with a leading edge, a trailing edge, and a flow fence extending therebetween.

The present application and the resultant patent further provide an example of a turbine nozzle airfoil. The turbine nozzle airfoil described herein may include a leading edge, a trailing edge, a pressure side, a suction side, and a flow fence extending from the leading edge to the trailing edge along the suction side. Other configurations may be used.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
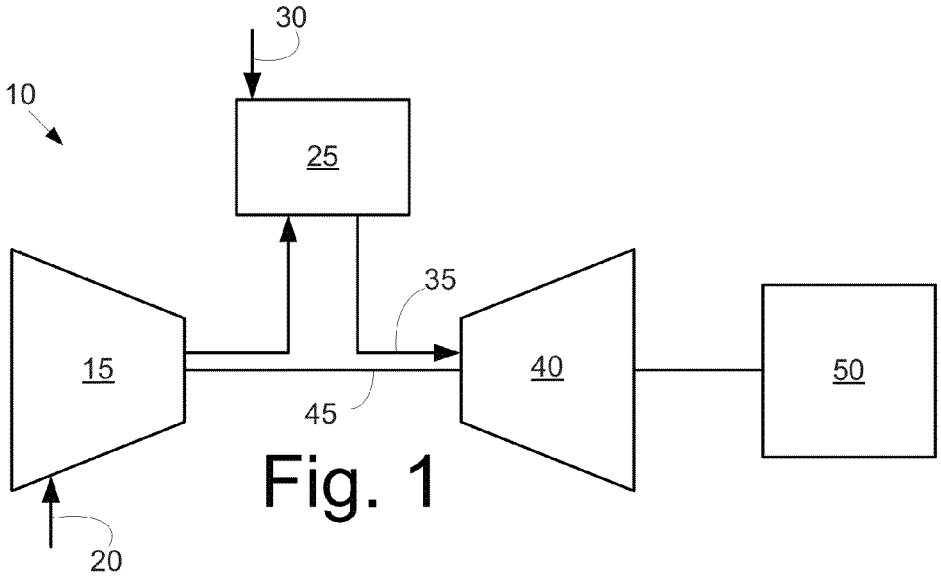
FIG. 1 is schematic diagram of a gas turbine engine showing a compressor, a combustor, and a turbine.

Referring now to the drawings, in which like numerals refer to like elements throughout the several views, FIG. 1 shows a schematic view of gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a pressurized flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like.

The gas turbine engine 10 may use natural gas, various types of syngas, and/or other types of fuels. The gas turbine engine 10 may be any one of a number of different gas turbine engines offered by General Electric Company of Schenectady, N.Y., including, but not limited to, those such as a 7 or a 9 series heavy duty gas turbine engine and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
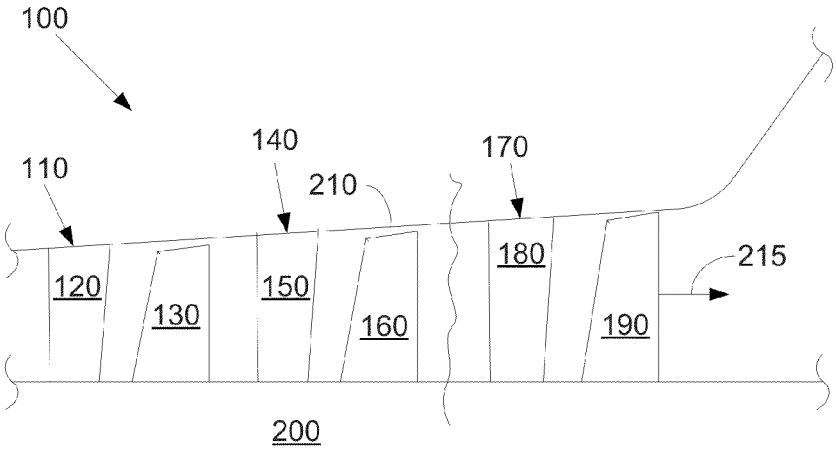
FIG. 2 is a schematic diagram of a portion of a turbine with a number of nozzles and a number of buckets as may be described herein.
Figure 3:
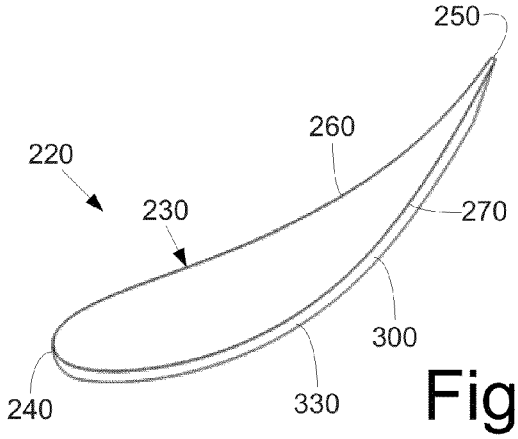
FIG. 3 is a side cross-sectional view of an example of a nozzle as may be used in the turbine of FIG. 2.
Figure 4:
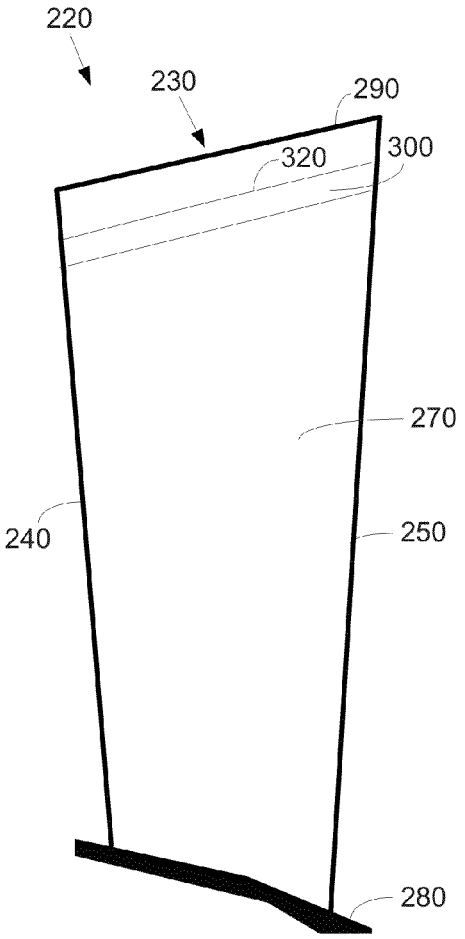
FIG. 4 is a side plan view of the nozzle of FIG. 3 with a flow fence positioned therein.
Figure 5:
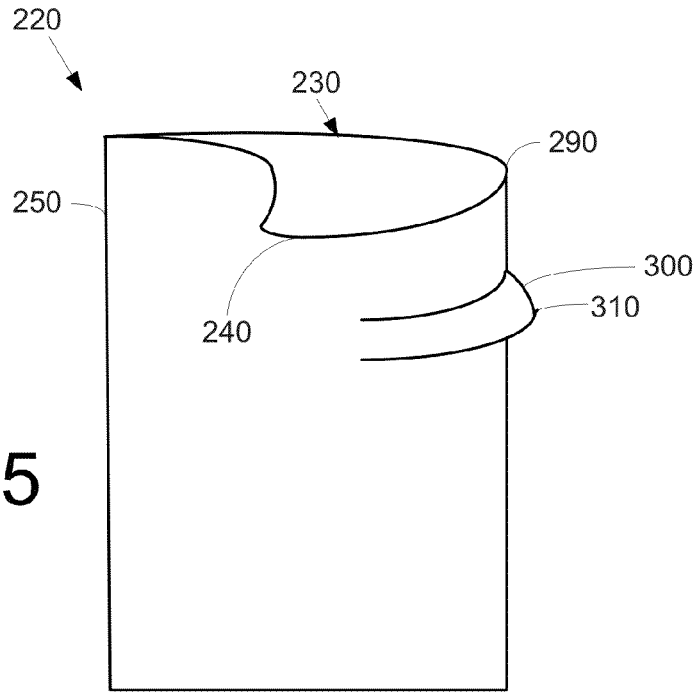
FIG. 5 is a leading edge view of the nozzle of FIG. 3.
Figure 6:
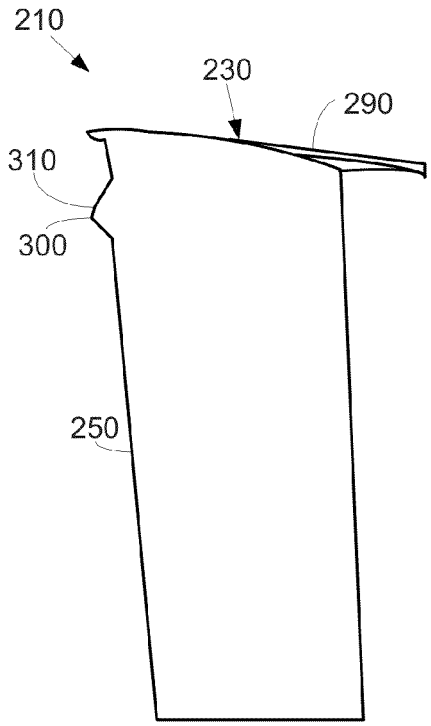
FIG. 6 is a trailing edge view of the nozzle of FIG. 3.

FIG. 2 shows an example of a portion of a turbine 100 as may be described herein. The turbine 100 may include a number of stages. In this example, the turbine 100 may include a first stage 110 with a number of first stage nozzles 120 and a number of first stage buckets 130, a second stage 140 with a number of second stage nozzles 150 and a number of second stage buckets 160, and a last stage 170 with a number of last stage nozzles 180 and a number of last stage buckets 190. Any number of the stages may be used herein with any number of the buckets 130, 160, 190 and any number of the nozzles 120, 150, 180.

The buckets 130, 160, 190 may be positioned in a circumferential array on a rotor 200 for rotation therewith. Likewise, the nozzles 120, 150, 180 may be stationary and may be mounted in a circumferential array on a casing 210 and the like. A hot gas path 215 may extend therethrough the turbine 100 for driving the buckets 130, 160, 190 with the flow of combustion gases 35 from the combustor 25. Other components and other configurations also may be used herein.

FIGS. 3-6 show an example of a nozzle 220 as may be described herein. The nozzle 220 may be one of the last stage nozzles 180 and/or any other nozzle in the turbine 100. The nozzle 220 may include an airfoil 230. Generally described, the airfoil 230 may extend along an X-axis from a leading edge 240 to a trailing edge 250. The airfoil 230 may extend along a Y-axis from a pressure side 260 to a suction side 270. Likewise, the airfoil 230 may extend along a Z-axis from a platform 280 to a tip 290. The overall configuration of the nozzle 220 may vary. Other components and other configurations may be used herein.

The nozzle 220 may have a flow fence 300 positioned about the airfoil 230. The flow fence 300 may be positioned near the tip 290 of the airfoil 230, i.e., the flow fence 300 may be positioned closer to the tip 290 than the platform 280. The flow fence 300 may extend outwardly from the leading edge 240 to the trailing edge 250 along the suction side 270. As is shown, the flow fence 300 may have a uniform thickness 330 across the suction side 270 from the leading edge 240 to the trailing edge 250. The flow fence 300 may smoothly blend into the leading edge 240 and the trailing edge 250. The flow fence 300 may extend in a largely linear direction 320 along the suction side 270 although other directions may be used herein. The flow fence 300 may have a largely V or U-shaped configuration 310 although other configurations may be used herein. Specifically, the flow fence 300 may have any size, shape, or configuration.

More than one flow fence 300 may be used herein. Although the flow fence 300 has been discussed in terms of the suction side 370, a flow fence 300 also may be positioned on the pressure side 260 and/or a number of flow fences 300 may be positioned along both the suction side 270 and the pressure size 260. The number, positioning, and configuration of the flow fences 300 thus may vary herein. Other components and other configurations may be used herein.

The use of the flow fence 300 about the nozzle 220 thus acts to direct the flow of combustion gases 35 in an axial direction so as to reduce the amount of radial flow migration. Reduction in the extent of the radial flow migration may be accompanied by a reduction in total pressure losses so as to improve overall blade row efficiency and performance. The flow fence 300 thus acts as a physical barrier to prevent such flow migration in that the flow fence 300 channels the flow in the desired direction. The use of the flow fence 300 also may be effective in reducing turbulence thereabout.

Figure 7:
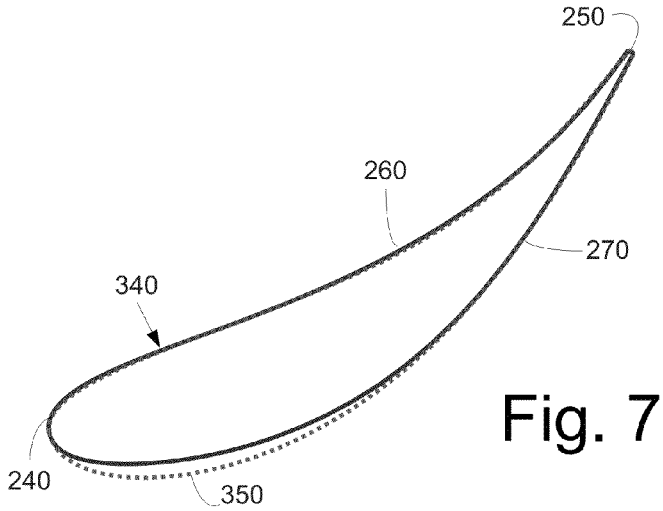
FIG. 7 is a side cross-sectional view of an example of an alternative embodiment of a nozzle as may be described herein.

Numerous modifications on the flow fence 300 may be used herein. For example, FIG. 7 shows an alternative embodiment of an airfoil 340. The airfoil 340 may have a forward leading flow fence 300. The forward leading flow fence 350 may extend further out from the airfoil 340 towards the leading edge 240. The forward leading flow fence 350 also may be substantially flush about the trailing edge 250. Other components and other configurations may be used herein.

Figure 8:
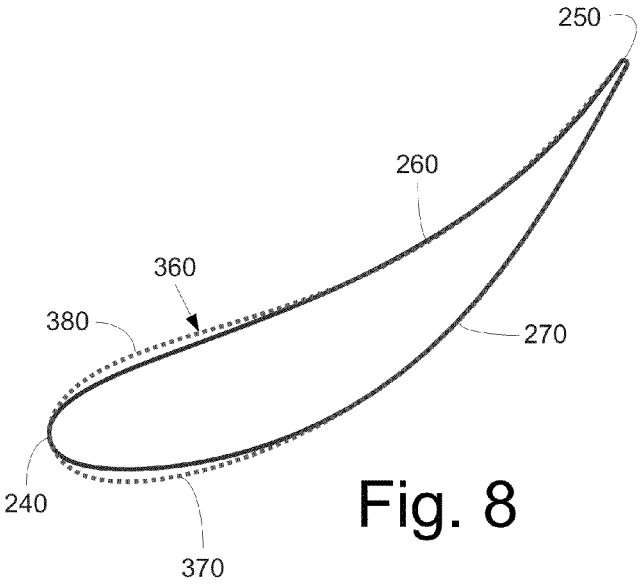
FIG. 8 is a side cross-sectional view of an example of an alternative embodiment of a nozzle as may be described herein.

FIG. 8 shows a further embodiment of an airfoil 360 as may be described herein. In this example, the airfoil 360 may have both a suction side flow fence 370 and a pressure side flow fence 380 on the pressure side 260. The flow fences 370, 380 may protrude out from the airfoil 360 more about the trailing edge 250 than the leading edge 240. Other components and other configurations may be used herein.

Figure 9:
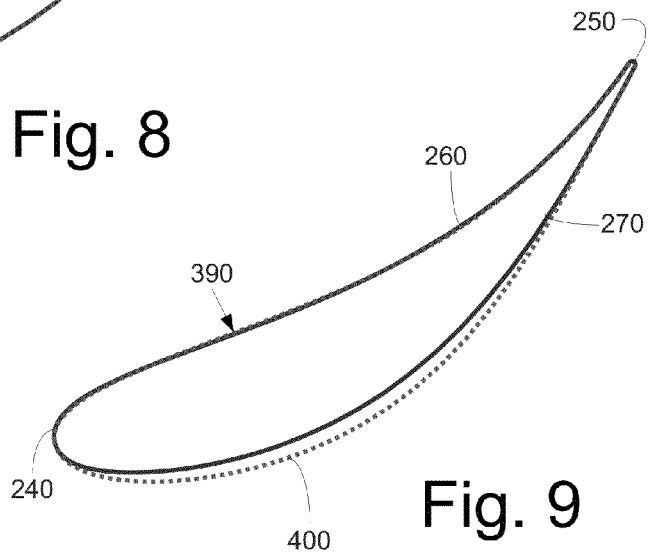
FIG. 9 is a side cross-sectional view of an example of an alternative embodiment of a nozzle as may be described herein.

FIG. 9 shows a further embodiment of an airfoil 390 as may be described herein. The airfoil 390 may have a middle budge flow fence 400 thereon. The middle budge flow fence 400 may be largely flush with the airfoil 390 about the leading edge 340 and the trailing edge 250 but extend outwards towards a middle thereof. Other components and other configurations may be used herein.

Figure 10:
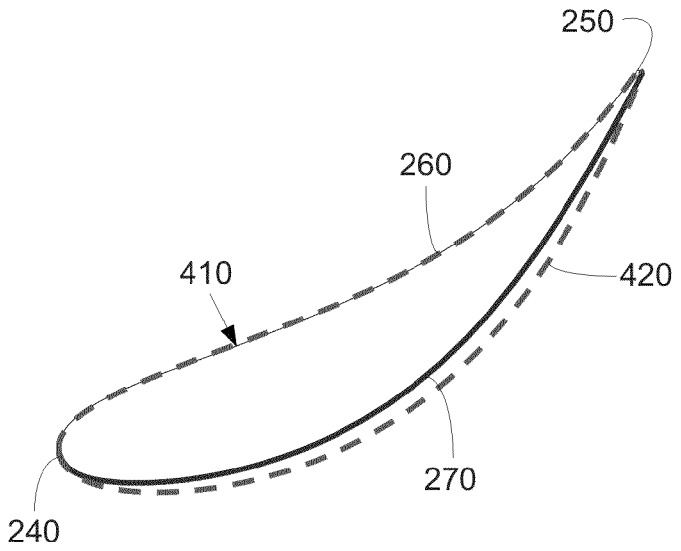
FIG. 10 is a side cross-sectional view of an example of an alternative embodiment of a nozzle as may be described herein.

FIG. 10 shows a further embodiment of an airfoil 410 as may be described herein. The airfoil 410 may have a rear leading flow fence 420 thereon. The rear leading flow fence 420 may be largely flush about the leading edge 240 but may extend outwardly along a middle and the trailing edge 250. Other components and other configurations may be used herein.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

I claim:

1. A turbine nozzle, comprising:

an airfoil;

the airfoil comprising a leading edge, a trailing edge, a suction side, and a pressure side; and a flow fence extending along the suction side comprising:

a first arcuate surface having a first constant radius of curvature extending from the suction side towards a base of the airfoil; and a second arcuate surface extending from the suction side towards the first arcuate surface, the second arcuate surface having a second constant radius of curvature that is different than the first constant radius of curvature, wherein the first and second arcuate surfaces converge at a line, thereby forming an edge of the flow fence along the line;

wherein:

the flow fence extends from the leading edge to the trailing edge of the airfoil;

the edge of the flow fence formed by the first and second arcuate surfaces is separated from the suction side a first distance at a position between the leading edge and the trailing edge and at a second distance at the leading edge and the trailing edge; and the first distance is greater than the second distance;

wherein the turbine nozzle is a last stage turbine nozzle.

2. The turbine nozzle of claim 1, wherein the airfoil extends from a base to a tip and wherein the flow fence is positioned adjacent to the tip.

3. The turbine nozzle of claim 1, wherein the first and second arcuate surfaces form a substantial V-like cross-sectional shape.

4. The turbine nozzle of claim 1, wherein the flow fence extends in a substantially linear direction.

5. The turbine nozzle of claim 1, wherein the flow fence comprises a uniform thickness as measured from a first intersection of the first arcuate surface and the suction side and a second intersection of the second arcuate surface and the suction side.

6. The turbine nozzle of claim 1, wherein the flow fence comprises a forward leading flow fence, wherein a forward portion of the flow fence positioned near the leading edge of the airfoil extends further from the suction side of the airfoil than a rearward portion of the flow fence positioned near the trailing edge of the airfoil.

7. The turbine nozzle of claim 1, further comprising a plurality of flow fences.

8. The turbine nozzle of claim 1, wherein the flow fence comprises a rear leading flow fence, wherein a rearward portion of the flow fence positioned near the trailing edge of the airfoil extends further from the suction side of the airfoil than a forward portion of the flow fence positioned near the leading edge of the airfoil.

9. The turbine nozzle of claim 1, wherein the flow fence is shaped to reduce flow migration in a flow of hot combustion gases along the airfoil.

10. The turbine nozzle of claim 1, wherein the flow fence is substantially parallel to a tip of the airfoil.

11. A turbine, comprising:

a plurality of nozzles; and a plurality of buckets;

the plurality of buckets comprising an airfoil;

the airfoil comprising a suction side, a pressure side, a leading edge, a trailing edge, and a flow fence extending between the leading edge and the trailing edge;

wherein the flow fence comprises:

a first arcuate surface having a constant radius of curvature extending from either the suction side or the pressure side of the airfoil;

a second flat surface extending from either the suction side or the pressure side of the airfoil and converging with the first arcuate surface at a line, such that the first arcuate surface and the second flat surface form an edge of the flow fence along the line of convergence;

wherein the first arcuate surface is positioned closer to a tip of the airfoil than the second flat surface.

12. The turbine of claim 11, wherein the flow fence extends along the suction side of the airfoil.

13. The turbine of claim 11, wherein the flow fence extends along the pressure side of the airfoil.

14. The turbine of claim 11, further comprising a plurality of flow fences.

15. The turbine of claim 11, wherein the airfoil extends from a base to a tip and wherein the flow fence is positioned adjacent to the tip.

16. The turbine of claim 11, wherein the flow fence is shaped to reduce flow migration in a flow of hot combustion gases along the airfoil.

17. A turbine nozzle airfoil, comprising:

a leading edge;

a trailing edge, a pressure side;

a suction side; and a flow fence extending from along a perimeter of the airfoil, wherein the flow fence comprises:

a first arcuate surface having a first constant radius of curvature extending from the suction side; and a second arcuate surface extending from the suction side towards the first arcuate surface, the second arcuate surface having a second constant radius of curvature that is different than the first constant radius of curvature, wherein the first and second arcuate surfaces converge at a line, thereby forming an edge of the flow fence along the line of convergence;

wherein the edge of the flow fence formed by the first and second arcuate surfaces is separated from the suction side a first distance at a first position between the leading edge and the trailing edge and is separated from the pressure side a second distance at a second position between the leading edge and the trailing edge, the first distance and the second distance being equal;

the flow fence blends into the leading edge and the trailing edge; and the turbine nozzle is a last stage turbine nozzle.

* * * * *

UNITED STATES PATENT AND TRADEMARK OFFICE

CERTIFICATE OF CORRECTION

PATENT NO. : 8,944,774 B2
APPLICATION NO. : 13/342256
DATED : February 3, 2015
INVENTOR(S) : Bielek It is certified that error appears in the above-identified patent and that said Letters Patent is hereby corrected as shown below:

In the Specification,

In Column 1, Line 10, delete "radial now" and insert -- radial flow --, therefor.

In Column 1, Line 29, delete "now migration" and insert -- flow migration --, therefor.

In Column 2, Line 1, delete "OF DRAWINGS" and insert -- OF THE DRAWINGS --, therefor.

In Column 3, Line 39, delete "side 370," and insert -- side 270, --, therefor.

In Column 3, Line 58, delete "fence 300." and insert -- fence 350. --, therefor.

In Column 4, Line 7, delete "edge 340" and insert -- edge 240 --, therefor.

Signed and Sealed this
Ninth Day of June, 2015

Michelle K. Lee

Michelle K. Lee
*Director of the United States Patent and Trademark Office*